US006694560B2

(12) United States Patent
Young

(10) Patent No.: US 6,694,560 B2
(45) Date of Patent: Feb. 24, 2004

(54) FIXTURE FOR MOP HEADS

(75) Inventor: Scot Young, Stourbridge (GB)

(73) Assignee: Ronald Alexander (Scot) Young, Stourbridge (GB)

( * ) Notice: Subject to any disclaimer, the term of this patent is extended or adjusted under 35 U.S.C. 154(b) by 188 days.

(21) Appl. No.: 10/037,813

(22) Filed: Jan. 4, 2002

(65) Prior Publication Data

US 2003/0126702 A1 Jul. 10, 2003

(51) Int. Cl.[7] ..... A47L 13/24
(52) U.S. Cl. ..... 15/147.1; 15/151; 15/229.2
(58) Field of Search ..... 15/147.1, 147.2, 15/150, 151, 228, 229.1, 229.2, 229.6

(56) References Cited

U.S. PATENT DOCUMENTS

| | | | | |
|---|---|---|---|---|
| 512,543 A | | 1/1894 | Froberg | |
| 659,918 A | | 10/1900 | Froberg | |
| 2,065,407 A | * | 12/1936 | Steuernagel | 15/151 |
| 3,457,581 A | | 7/1969 | Oas | |
| 4,287,632 A | | 9/1981 | Hammond | |
| 4,553,282 A | | 11/1985 | Batchelor | |
| 4,995,134 A | * | 2/1991 | Monahan | 15/151 |
| 5,560,070 A | | 10/1996 | Reaume | |
| 5,701,628 A | | 12/1997 | Morad | |
| 5,724,696 A | | 3/1998 | Di Giammarino | |
| 5,918,340 A | | 7/1999 | Young | |
| 6,098,235 A | | 8/2000 | Tomm et al. | |

FOREIGN PATENT DOCUMENTS

| | | | |
|---|---|---|---|
| JP | 11-9536 | * | 1/1999 |

* cited by examiner

*Primary Examiner*—Terrence R Till
(74) *Attorney, Agent, or Firm*—Wm. Bruce Day

(57) ABSTRACT

A mop fixture for receiving and holding a mop head has a hood of resilient polymeric material which is attachable to a mop handle. A mop retaining bar has opposite ends terminating in down turned hook portions and snaps into spaced end walls of the hood. A mop head with depending opposite strand bunches is centered by the mop retaining bar so that the center of the mop head is retained within the hood.

4 Claims, 1 Drawing Sheet

FIXTURE FOR MOP HEADS

FIELD OF THE INVENTION

This invention relates to mops and particularly to fixtures for holding mop heads so that they can be manufactured and connected to mop heads by fast, reliable automated production.

BACKGROUND OF THE INVENTION

Mops, in particularly, wet mops are widely used to clean floors of homes, offices, vehicles and boats. The mop is usually composed of three components, an elongate mop handle, a mop head, typically consisting of an assemblage of cotton or other fibrous strands which are bunched or gathered together in a center and finally a mop fixture to which the handle is attached and which connects the mop head to the handle. Some mop fixtures do not accommodate fast, labor free automated production.

Mop fixtures have been constructed in various forms and range from simple end clips to more complex clamps of metal or plastic. While there has been significant development in mop fixtures, many are subject to loosening, many do not sufficiently tightly grip the mop head, allowing it to become loose, many are subject to fracturing, some are too heavy and all have various infirmities for which the present invention is intended to overcome.

OBJECTS OF THE INVENTION

The objects of the present invention are:

1. to provide a mop fixture for receiving and holding a mop head which is formed of a resilient polymeric material which is not subject to rusting and is substantially unbreakable in use;
2. to provide such a mop fixture by which a mop head can readily be assembled using automated production methods;
3. to provide such a mop fixture which utilizes an inner clip fastener that fits within a chambered hood and clips to openings on opposite ends of the hood; and
4. to provide such a mop fixture which is particularly sturdy and efficient in use.

Other objects and advantages of the present invention will become apparent from the following disclosure.

SUMMARY OF THE INVENTION

A mop fixture for receiving and holding a mop head includes a hood of resilient polymeric material. The hood has front and rear spaced apart substantially vertical walls, lateral end walls connected to the front and rear walls and a top wall connected to the front, rear and end walls and forming a cavity to receive a mop head. A handle end receiving tubular boss is formed integrally with the hood and extends upwardly therefrom. A mop retaining bar has opposite ends terminating in down turned hook portions and is of a length extending the length of the hood and slightly larger than the hood so that the bar hook portions snap into slots in the hood end walls and securely hold the mop head within the fixture. This fixture eliminates any need to stitch individual mop strands on strips at the center of the mop head.

DESCRIPTION OF THE PREFERRED EMBODIMENT

As required, a detailed description of the preferred embodiment is disclosed herein, however, other embodiments or configurations may be apparent and within the concept of this invention and may be based upon the following description to those having ordinary skill in the art.

Figure 1:
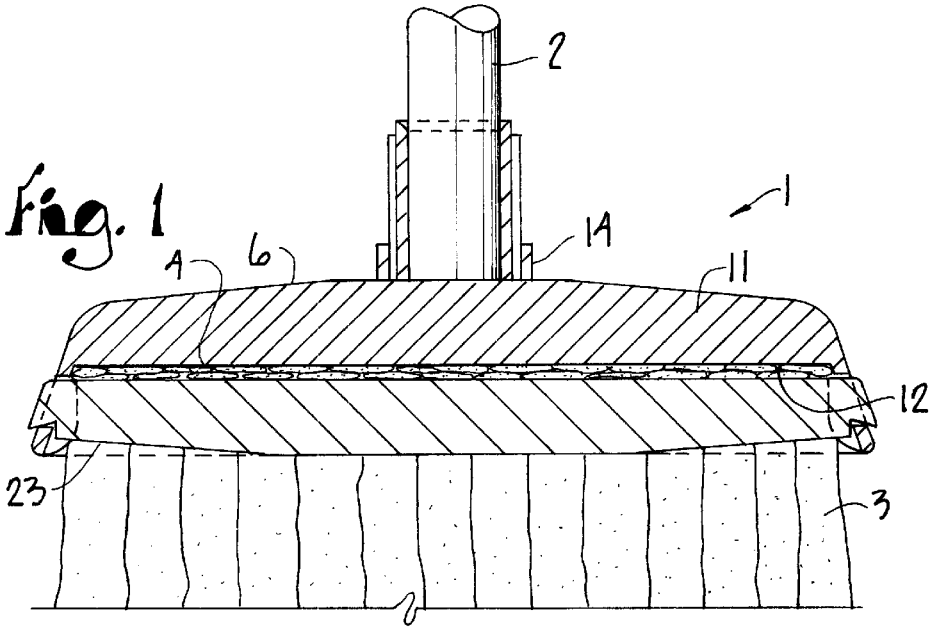
FIG. 1 is a longitudinal sectional view of a mop fixture embodying the present invention and showing a mop handle and mop head attached thereto.

The reference numeral 1, FIG. 1 generally indicates a mop fixture embodying the present invention. The mop fixture 1 attaches to a mop handle 2 and secures a mop head 3 to the handle 1 for use as an assembly for mopping purposes. The mop handle 2 is an elongate stick formed of wood, tubular metal or fiberglass. The mop head 3 may be formed of various types of materials such as non woven materials and in various configurations such as sandwich fold or fan-fold embodiments. For purposes of providing an exemplar, the mop head 3 is formed of strips of non woven material which are strand or ribbon-like in appearance and are formed with spaced end sections about a center portion 4 which is gathered and received within the mop fixture 1.

Figure 2:
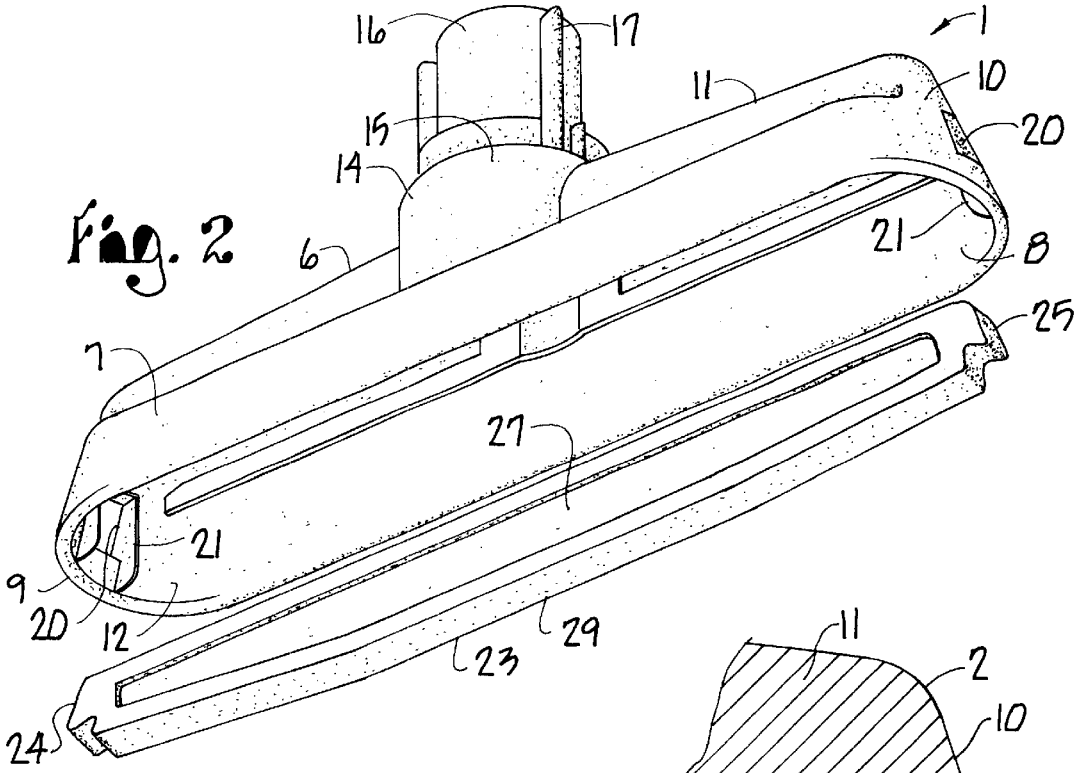
FIG. 2 is a disassembled perspective view of the mop fixture.

As shown in FIG. 2, the mop fixture 1 is formed of a hood of resilient polymeric material such as polypropylene. The hood 6 is generally formed with front and rear spaced apart substantially vertical walls 7 and 8, lateral end walls 9 and 10, and a top wall 11 connected to the front rear and end walls 7 through 10 to form a cavity 12 therein to receive the mop head 3. The top wall 11 preferably takes the form of a narrow extended solid rib so as to lend strength to fixture 1 to prevent bending. The walls 7 and 8 extend longitudinally and parallel to the top rib wall 11 and flare outwardly then downwardly, forming shoulders at the flare. The walls 7 and 8 flex resiliently at the shoulder flare to squeeze upon the double center of a mop head when the mop head is installed and flex when the mop head is placed in a wringer and squeezed tight so as to more fully enable extraction of water than would be possible with other types of fixtures. A centered boss 14 extends upwardly from the top wall 11 and receives the end of the mop handle 2 therein. As illustrated, the boss 14 includes a lower shoulder forming portion 15 and an upper receptacle 16 strengthened by vanes 17. The strength of the portions of the boss 14 resist flexing between the mop handle 2 and the fixture 1. Similarly, the significant strength of the solid top wall rib 11 resists longitudinal flexing of the mop fixture 1. The end walls 9 and 10 are semicircular in form so as to form the cavity in a generally oval form. The end walls 9 and 10 have vertically oriented slots 20 therein which are strengthened by spaced guide vanes 21 bracketing the sides of the slots 20.

Figure 3:
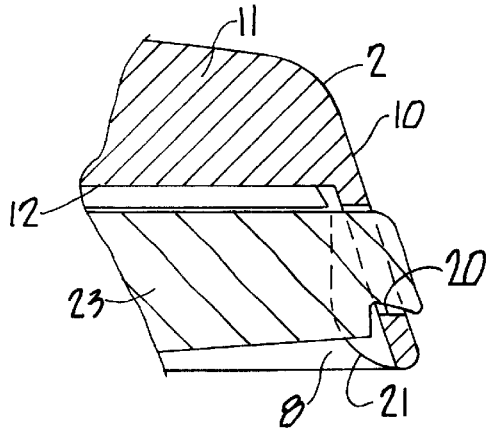
FIG. 3 is a fragmentary view of interconnecting portions of the mop fixture.

A retaining bar 23 has opposite ends 24 and 25 terminating in down turned hook portions which snap into the respective slots 20. The retaining bar 23 includes a longitudinal depressed center section 27 for conservation of material and the ends 24 and 25 taper from a tapered center 29 to maximize strength. The down turned hook ends 24 and 25 are sized to be snugly received and snap into the slots 20, as shown in FIG. 3 and are guided therein by the guide vanes 21.

Manufacture, as by automated equipment, the mop head 3 is positioned so that its center portion 4 is laid over the cavity 12 of the mop fixture hood 6 and the retaining bar 23 snapped therein by machinery pushing down on the ends until the hook portions slide into and are captured within the slots 20 on both ends. Thereafter, the mop is ready for use. The polypropylene material of the mop fixture 1 can compress slightly when laterally squeezed, as by a mop wringer. This compression assists in wringing out flowable water from the mop. Dimensions and details of configuration may be selected to accord with various wringer designs, such as those wringers manufactured by assignee Scot Young Research, Ltd.

What is claimed and desired to be protected by Letters Patent is:

1. A mop fixture for receiving and holding a mop head, and comprising:

a. a hood of resilient polymeric material;

b. the hood having front and rear spaced apart substantially vertical walls, lateral end walls connected to the front and rear walls, and a top wall connected to the front, rear and end walls and forming a cavity therein to receive a mop head;

c. a handle end-receiving tubular boss integral with the hood and extending upwardly therefrom; and d. a mop retaining bar having opposite ends terminating in down turned hook portions, said bar being of a length extending the length of the hood and slightly longer than the hood so that said hook portions snap into slots in the hood end walls.

2. The mop fixture set forth in claim 1 wherein the end walls of said hood have guide vanes bracketing said slots.

3. A mop fixture for receiving and holding a mop head, and comprising:

a. a hood of resilient, polymeric material;

b. the hood having front and rear spaced apart substantially vertical side walls, lateral end walls connected to the front and rear walls, and a top wall connected to the front, rear and end walls and forming a cavity therein to receive a mop head;

c. a handle end-receiving tubular boss integral with the hood and extending upwardly therefrom; and d. a mop retaining bar having opposite ends terminating in down turned hook portions, said bar being of a length extending the length of said hood and slightly longer thereof so that said hook portions snap into slots in the hood end walls, the slots being bracketed by guide vanes.

4. A mop assembly comprising:

a. a hood of resilient polymeric material;

b. the hood having front and rear spaced apart substantially vertical walls, lateral end walls connected to the front and rear walls, and a top wall connected to the front, rear and end walls and forming a cavity therein to receive a mop head;

c. a handle end-receiving tubular boss integral with the hood and extending upwardly therefrom, and a handle inserted into the boss;

d. a mop retaining bar having opposite ends terminating in down turned hook portions, said bar being of a length extending the length of said hood and slightly longer thereof so that said hook portions snap into slots in the hood end walls, the slots being bracketed by guide vanes; and e. a mop head retained in said hood and having strands hanging down therefrom.

* * * * *